United States Patent [19]

Serba

[11] Patent Number: 4,728,001

[45] Date of Patent: Mar. 1, 1988

[54] BEVERAGE CONTAINER AND PACKAGING METHOD

[76] Inventor: Henry S. Serba, 4343 N. Clarendon, Apt. 1512, Chicago, Ill. 60613

[21] Appl. No.: 23,542

[22] Filed: Mar. 9, 1987

[51] Int. Cl.[4] ..... A47G 19/22

[52] U.S. Cl. ..... 220/90.2; 215/1 A; 229/7 S

[58] Field of Search ..... 220/90.2, 90.4, 90.6; 229/7 S; 215/1 A

[56] References Cited

U.S. PATENT DOCUMENTS

| | | | |
|---|---|---|---|
| 3,326,695 | 6/1967 | Neuhauser | 215/1 A |
| 3,559,868 | 2/1971 | Chang | 220/90.2 |
| 3,636,654 | 4/1972 | Brinkley | 220/90.2 |
| 4,036,392 | 7/1977 | Martin | 229/7 S |
| 4,247,016 | 1/1981 | Shaw | 220/90.2 |

*Primary Examiner*—George E. Lowrance
*Attorney, Agent, or Firm*—Wood, Dalton, Phillips, Mason & Rowe

[57] ABSTRACT

A beverage container having a drinking straw packaged with a beverage therein. The beverage container comprises a hollow container having a top end and a bottom end joined by a side wall. The top end has a normally sealed pour opening which is adapted to be opened upon demand for access to the beverage in the hollow container. The hollow container is filled with the beverage to a level near the top end thereof. The beverage container also includes a drinking straw disposed in the hollow container. The drinking straw is defined by a tube having an open drinking passage extending completely therethrough and is initially bent intermediate opposing ends thereof into a generally circular configuration substantially disposed in a plane with the opposing ends in generally adjacent relation. The drinking straw floats on the beverage near the top end of the hollow container. The beverage container also includes the drinking straw having at least one of the opposing ends bent to project at an angle to the plane defined by the portion of the tube in the generally circular configuration. The one of the opposing ends projects upwardly of the plane and inwardly of the generally circular configuration by a distance sufficient to extend through the pour opening for removal of the tube. The tube is at least partially removable from the hollow container through the pour opening, bent substantially from the generally circular configuration into a generally straight configuration during the partial removal, and is thereafter reinsertable into the hollow container through the pour opening. With this arrangement, the drinking straw can be packaged in the beverage container with the beverage in a first configuration and can be at least partially removed from the beverage container for reinsertion for drinking the beverage in a second configuration.

20 Claims, 5 Drawing Figures

BEVERAGE CONTAINER AND PACKAGING METHOD

FIELD OF THE INVENTION

The present invention generally relates to a beverage container and packaging method and, more particularly, to a beverage container having a drinking straw packaged therein and a method of packaging a drinking straw in a beverage container.

BACKGROUND OF THE INVENTION

In the past, there have been a wide range of proposals for providing a straw for utilization with a beverage container. These proposals all recognize the fact that there are both sanitary and practical reasons for preferring to consume a beverage from a can, bottle or other container directly through a straw rather than through the pour opening normally provided therein. Unfortunately, the proposals that have been made to date have not been accepted commercially for several reasons.

Among the reasons for preferring a straw, one of the most important is the fact that beverage containers particularly in the form of cans are almost always unsanitary. It is known, for instance, that in the case of carbonated beverages, such cans have a pour opening defined by a score line in the top end thereof together with a lever-type arrangement to separate the tab defined within the score line at least partially from the remainder of the top end of the can. When this has been done, the normal expectation of the soft drink company is that the consumer will drink the beverage from the can directly through the pour opening.

However, the can has undoubtedly been handled by others in transit to the consumer. This is inevitable in the normal distribution chain whereby the can may travel from the soft drink company, for instance, to a distribution point, to a retailer, and ultimately to the consumer. In this chain, the can may become contaminated by reason of such handling.

Moreover, this problem is even more pronounced when a consumer purchases a canned beverage from a soft drink machine. It is usually difficult, if not impossible, for the consumer to clean the area around the pour opening of a beverage container where the beverage is purchased from a machine for immediate consumption, as it might otherwise be for canned beverages purchased in a retail store and brought to the home of the consumer for consumption at a later time. As a result, the sanitary concerns are often paramount to the ordinary consumer.

Along these same lines is the problem of an accumulation of dirt in the vicinity of the pour opening. This is difficult to avoid, particularly where beverage containers may remain in a retail outlet for some period of time during which dust and the like can easily settle on the top end of a beverage container in and around the tab and lever mechanism associated with the pour opening. In fact, this result can also exist with machines for carbonated beverages in the event of unsatisfactory stocking practices.

Even with those for whom sanitation is not a concern of significance, there is another practical reason for the desirability of drinking straw use. This involves the fact that the standard tab and lever arrangement, whereby a portion of the top end of a beverage container is at least partially separated from the remainder thereof, leaves a sharp edge which can cause injury by reason of a cut to the lip or tongue of the consumer. Because of these reasons and others, it would be highly desirable to package a drinking straw with a can or other beverage container.

While the desirability is recognized, it is equally true that providing a drinking straw should be successfully accomplished with minimal expense. This means that the can or beverage container should require, preferably, no modification whatsoever, and the drinking straw should be packaged integral therewith taking into account all of the normal practices associated with the beverage industry. Unfortunately, the proposals that have been made to date have not been adapted because they have clearly failed to meet these criteria in a satisfactory fashion.

Among the earlier unsuccessful attempts to provide a drinking straw for use with a beverage container are those disclosed in U.S. Pat. Nos. 4,356,927; 4,134,247; 4,305,521; 4,247,016; 4,036,392; 3,874,554; 3,717,476; 3,656,654; 3,326,695; 3,211,379; 1,309,994; and 1,253,579.

The present invention is directed to overcoming the above stated problems, and the failures of the earlier attempts to overcome same, by accomplishing the above stated objects in a unique beverage container and packaging method.

SUMMARY OF THE INVENTION

Accordingly, the present invention is directed to a beverage container having a drinking straw packaged with a beverage therein. The beverage container comprises a hollow container having a top end and a bottom end joined by a side wall. The top end has means defining a pour opening therein and includes means normally sealing the pour opening. The hollow container is filled with the beverage to a level near the top end thereof. In addition, the sealing means is releasable upon demand to expose the pour opening for access to the beverage in the hollow container.

The beverage container further comprises a drinking straw disposed in the hollow container. The drinking straw takes the form of a tube having an open drinking passage extending completely therethrough and initially is bent intermediate opposing ends thereof into a generally circular configuration substantially disposed in a plane with the opposing ends generally in adjacent relation. The drinking straw floats on the beverage near the top end of the hollow container. The drinking straw also includes means for bending the tube into the generally circular configuration and then maintaining the tube in the generally circular configuration with the drinking passage open in a manner later accommodating bending of the tube into a generally straight configuration for use thereof. Furthermore, at least one of the opposing ends of the tube is bent to project at an angle to the plane defined by the tube in the generally circular configuration.

More specifically, the one of the opposing ends projects upwardly of the plane and inwardly of the generally circular configuration. It projects upwardly of the plane by a distance sufficient to extend through the pour opening for removal of the tube upon release of the sealing means. In this manner, the tube is easily accessible for partial or complete removal from the hollow container through the pour opening of the beverage container.

With the features of the invention, the tube is substantially bent from the generally circular configuration into the generally straight configuration during partial or complete removal from the hollow container. It is thereafter reinsertable into the hollow container through the pour opening for use of the drinking straw. As a result, the drinking straw can be packaged in the beverage container with the beverage in a first configuration and can be partially or completely removed from the beverage container for reinsertion after substantial straightening in a second configuration.

In an exemplary embodiment, the tube includes a plurality of corrugations intermediate the opposing ends to define the bending means, and the corrugations are disposed therealong to allow the tube to be bent into the generally circular configuration. Preferably, the corrugations are uniformly disposed at a plurality of discrete locations along the tube, terminating at points inwardly of the opposing ends of the tube. Alternatively, the corrugations are uniformly disposed substantially entirely along the tube terminating at points inwardly of the opposing ends thereof.

In the preferred embodiment, the opposing ends of the tube are each bent to project at an angle to the plane defined by the portion of the tube in the generally circular configuration. One of the opposing ends of the tube then projects upwardly of the plane and inwardly of the generally circular configuration. Similarly, the other of the opposing ends of the tube projects downwardly of the plane and inwardly of the generally circular configuration.

Still other details of the preferred embodiments include the hollow container being generally cylindrical in shape. The top end and the bottom end are then generally circular in shape. In like fashion, the side wall is then generally cylindrical in shape to cooperate with the generally circular top and bottom ends in conventional fashion.

Preferably, the means defining the pour opening includes a score line in the top end and the means normally sealing the pour opening is an integral portion of the top end. The integral portion of the top end advantageously defines a tab disposed inwardly of the score line and means are provided for at least partially separating the tab along the score line from the remainder of the top end. With these features, the separating means preferably includes a lever normally disposed in generally parallel relationship to the top end and secured to the top end for pivotal movement relative thereto.

Still further details of the preferred embodiment include the lever having a finger engaging end and a tab engaging end. The lever is then mounted for pivotal movement intermediate the finger engaging end and the tab engaging end with the tab engaging end of the lever being disposed over the tab and the finger engaging end of the lever being disposed in longitudinally spaced relation thereto. Furthermore, a rivet preferably mounts the lever to the top end for pivotal movement adjacent the tab engaging end in remote relation to the finger engaging end.

The present invention is also directed to a method of packaging a drinking straw in a beverage container. The method comprises the step of providing a hollow container having a side wall joined to a bottom end and having a separate top end. Next, the top end is formed to have means defining a pour opening therein and to have means for releasably sealing the pour opening. Then, the hollow container is filled with a beverage while the top end is still separate from the remainder of the hollow container. Next, a drinking straw is provided comprising a tube having opposing ends and having an open drinking passage extending completely therethrough. Next, the tube is bent intermediate the opposing ends into a generally circular configuration substantially disposed in a plane with the opposing ends in generally adjacent relation. Then, one of the opposing ends is bent to project upwardly of the plane and inwardly of the generally circular configuration. Next, the drinking straw is placed into the hollow container such that the generally circular configuration floats on the beverage. Finally, the top end is sealed to the side wall of the hollow container with the upwardly and inwardly projecting end of the tube in engagement therewith.

Other objects, advantages and features of the present invention will become apparent from a consideration of the following specification taken in conjunction with the accompanying drawings.

DETAILED DESCRIPTION OF THE PREFERRED EMBODIMENT

Figure 1:
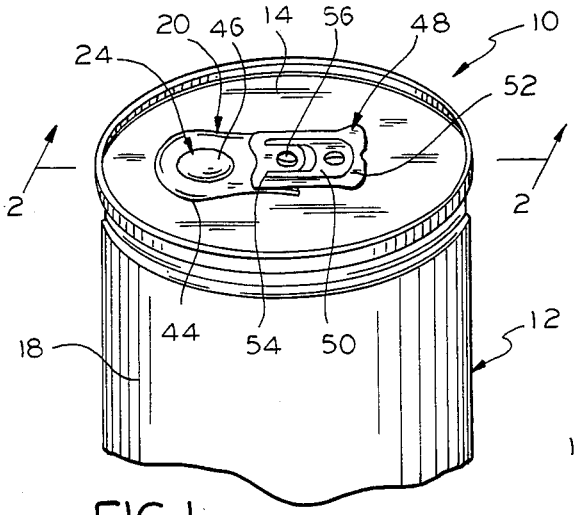
FIG. 1 is a perspective view of a beverage container in accordance with the present invention.
Figure 2:
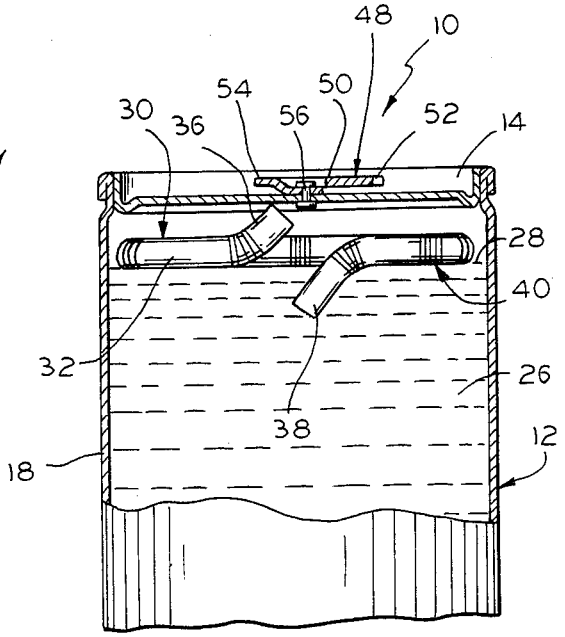
FIG. 2 is a cross-sectional view taken on the line 2—2 of FIG. 1 with the beverage container closed.
Figure 3:
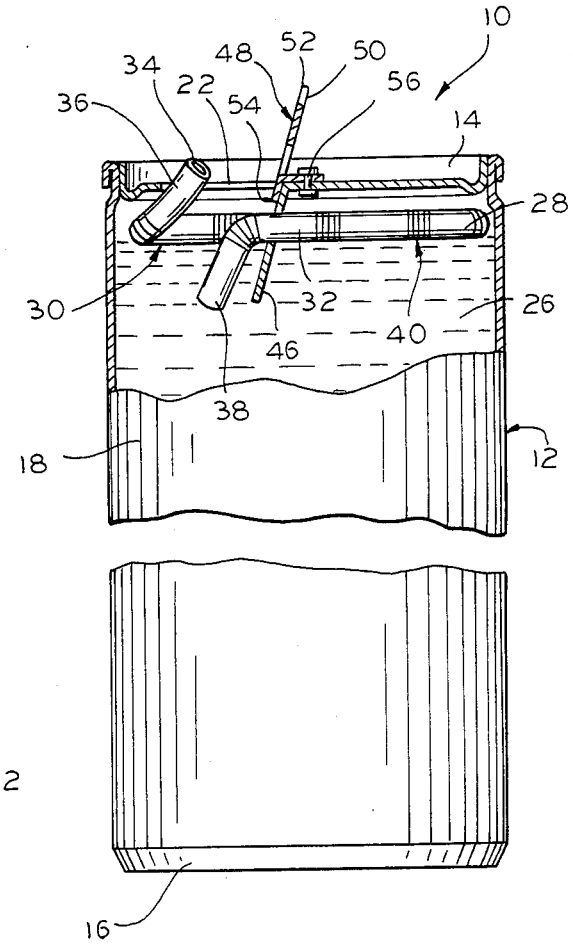
FIG. 3 is a cross-sectional view taken on the line 3—3 of FIG. 1 with the beverage container opened.

An exemplary embodiment of a beverage container having a drinking straw packaged with a beverage contained therein is illustrated in FIGS. 1–3. The beverage container generally designated 10 includes a hollow container 12 having a top end 14 and a bottom end 16 joined by a side wall 18. The top end 14 has means 20 defining a pour opening 22 therein and includes means 24 normally sealing the pour opening 22. The hollow container 12 is filled with the beverage 26 to a level as at 28 near the top end 14 thereof. With this arrangement, the sealing means 24 is releasable upon demand to expose the pour opening 22 for access to the beverage 26 in the hollow container 12.

Referring now to FIGS. 1–4, the beverage container 10 also includes a drinking straw 30 disposed in the hollow container 12. The drinking straw 30 comprises a tube 32 having an open drinking passage 34 extending completely therethrough and is initially bent intermediate opposing ends 36,38 thereof into a generally circular configuration substantially disposed in a plane (see FIGS. 2 through 4, in particular). The drinking straw 30 floats on the beverage 26 near the top end 14 of the hollow container 12. The drinking straw 30 also includes means 40 for bending the tube 32 into the generally circular configuration and then maintaining the tube 32 in the generally circular configuration with the drinking passage 34 open in a manner accommodating later bending of the tube 32 into a generally straight configuration for use thereof (see FIG. 5, in particular).

As shown in FIG. 2, at least one of the opposing ends 36,38 of the tube 32 is bent to project at an angle to the plane defined by the remainder of the tube 32 in the generally circular configuration. The one end 36 of the opposing ends 36,38 projects upwardly of the plane and inwardly of the generally circular configuration where it is in contact with the underside of the top end 14 (see, also, FIG. 4). Moreover, the one end 36 of the opposing ends 36,38 of the tube 32 projects upwardly of the plane by a distance sufficient to extend through the pour opening 22 for removal of the tube 32 upon release of the sealing means 24 (see FIG. 5).

As will be appreciated, the tube 32 is partially or completely removable from the hollow container 12 through the pour opening 22. The tube will be substantially bent from the generally circular configuration into the generally straight configuration (compare FIGS. 4 and 5) during partial or complete removal from the hollow container 12 by reason of the engagement of the tube with the edge of the pour opening 22. Still further, the tube 32 is thereafter reinsertable into the hollow container 12 through the pour opening 22.

With these features, the drinking straw 30 can be packaged in the beverage container 10 with the beverage 26 in a first configuration. Subsequently, the drinking straw 30 can be partially or completely removed from the beverage container 10 for reinsertion after straightening for drinking the beverage 26 in a second configuration.

Figure 4:
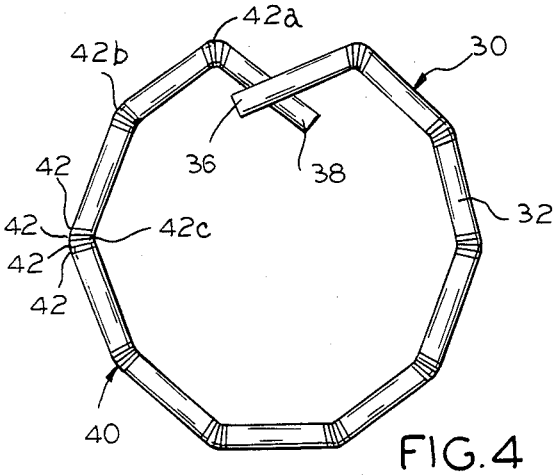
FIG. 4 is a top plan view of a drinking straw for utilization with the beverage container of FIG. 1.
Figure 5:
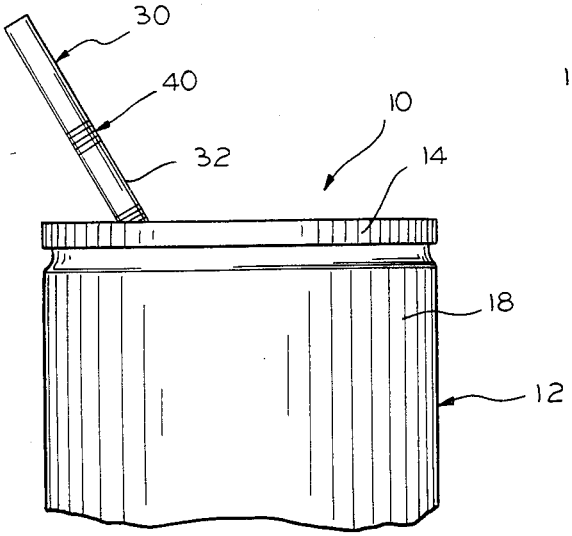
FIG. 5 is a side elevational view of a beverage container with a drinking straw in a use position.

As best shown in FIG. 4, the tube 32 includes a plurality of corrugations 42 intermediate the opposing ends 36,38 to define each of the bending means 40, and the corrugations 42 are disposed to allow the tube 32 to be bent into the generally circular configuration. In the preferred embodiment, the corrugations 42 are uniformly disposed at a plurality of discrete locations 42*a,b,c,* etc. along the tube 32 terminating at points inwardly of the opposing ends 36,38 of the tube 32. Alternatively, the corrugations 42 can be uniformly disposed substantially entirely along the tube 32 terminating at points inwardly of the opposing ends 36,38 of the tube 32, as will be appreciated by those skilled in the art.

In the preferred embodiment, the opposing ends 36,38 are each bent to project at an angle to the plane defined by the tube 32 in the generally circular configuration. One end 36 of the opposing ends 36,38 projects upwardly of the plane and inwardly of the generally circular configuration. Similarly, the other end 38 of the opposing ends 36,38 projects downwardly of the plane and inwardly of the generally circular configuration.

Referring to FIGS. 1 and 3, the hollow container 12 is generally cylindrical in shape. The top end 14 and the bottom end 16 are thus generally circular in shape. In like fashion, the side wall 18 is thus generally cylindrical in shape.

As best shown in FIG. 1, the means 20 defining the pour opening 22 includes a score line 44 in the top end 14 and the means 24 normally sealing the pour opening 22 is an integral portion of the top end 14. More specifically, the integral portion of the top end 14 comprises a tab 46 (see FIG. 5) disposed inwardly of the score line 44, and the beverage container 10 also includes means 48 for at least partially separating the tab 46 along the score line 44 from the remainder of the top end 14. Preferably, the separating means 48 includes a lever 50 (again, see FIG. 5) normally disposed in generally parallel relationship to the top end 14 and secured to the top end 14 for pivotal movement relative thereto.

Still referring to FIG. 1, the lever 50 includes a finger engaging end 52 and a tab engaging end 54. The lever 50 is mounted for pivotal movement intermediate the finger engaging end 52 and the tab engaging end 54 with the tab engaging end 54 of the lever 50 being disposed over the tab 46 and the finger engaging end 52 of the lever 50 being disposed in longitudinally spaced relation thereto. With this construction, a rivet 56 is used to mount the lever 50 to the top end 14 for pivotal movement, and the rivet 56 is disposed adjacent the tab engaging end 54 in remote relation to the finger engaging end 52 of the lever 50.

In accordance with the invention, a method of packaging a drinking straw 30 in a beverage container 10 is provided. The method includes the step of providing a hollow container 12 having a side wall 18 joined to a bottom end 16 and having a separate top end 14. Next, the top end 14 is formed to have means 20 defining a pour opening 22 therein and to have means 24 for releasably sealing the pour opening 22. Then, the hollow container 12 is filled with a beverage 26 while the top end 14 is still separate from the remainder of the hollow container 12. Next, a drinking straw 30 is provided comprising a tube 32 having opposing ends 36,38 and having an open drinking passage 34 extending completely therethrough. Then, the tube 32 is bent intermediate the opposing ends 36,38 into a generally circular configuration substantially disposed in a plane with the opposing ends 36,38 in generally adjacent relation. Next, one end 36 of the opposing ends 36,38 is bent to project upwardly of the plane and inwardly of the generally circular configuration. Then, the drinking straw 30 is placed into the hollow container 12 such that the generally circular configuration floats on the beverage 26. Finally, the top end 14 is sealed to the side wall 18 of the hollow container 12 with the upwardly and inwardly projecting opposing end 36 of the tube 32 in engagement therewith.

Preferably, the opposing ends 36,38 are each bent to project at an angle to the plane defined by the tube 32, as previously mentioned. Thus, one end 36 of the opposing ends 36,38 projects upwardly of the plane and inwardly of the generally circular configuration, and the other end 38 of the opposing ends 36,38 projects downwardly of the plane and inwardly of the generally circular configuration. With this arrangement, the drinking straw 30 can be placed into the hollow container 12 with either of the opposing ends 36,38 projecting upwardly.

While not to be limited to any material, it will be appreciated by those skilled in the art that the drinking straw 30 can be formed of plastic that is compatible with the beverage. It will also be appreciated that the corrugations 42, which are preferably disposed at discrete locations 42*a*,42*b*,42*c*, etc. along the length of the drinking straw 30, will be spaced in a manner so that the generally circular configuration discussed in detail hereinabove can be achieved. Moreover, the corrugations 42 will terminate inwardly of the opposing ends 36,38 sufficient for one of the opposing ends 36 or 38 to extend through the pour opening 22 after partial separation of the tab 46.

In this connection, the invention is particularly well suited for carbonated beverage containers. The carbonated beverage contained therein is usually filled to a point in non-contacting adjacent relation to the top end of the beverage container because of the carbonation in the beverage whereby the gas can accumulate in the space above the level of the beverage. Moreover, with carbonated beverage, the straw will easily float at the surface level of the beverage.

When the tab has been partially separated from the top end of the beverage container, the one of the opposing ends projecting upwardly and inwardly may not immediately extend through the pour opening. This will be the case, of course, unless the one of the opposing ends is positioned exactly at the point of the pour opening but, in any event, the one of the opposing ends can be made to extend through the pour opening by simply moving the beverage container through repeated circular motions which will cause the beverage and, thus, the drinking straw to twirl within the beverage container. As a result, at the moment the upwardly and inwardly projecting end of the drinking straw is in alignment with the pour opening, it will immediately pop through the pour opening where it can be grasped for partial or complete removal and straightening by the consumer.

After the drinking straw has been straightened, it can simply be reinserted into the beverage container through the pour opening in typical straw-like fashion. Thus, the drinking straw can be used in normal fashion but can also be packaged in a conventional beverage container without any modification thereto or added expense other than the minimal cost of the drinking straw itself. For this reason, the present invention is well-suited for overcoming the problems encountered in the prior art as described in detail hereinabove.

While not previously mentioned in the above description, it will be appreciated that one of the ends is advantageously bent to project upwardly and inwardly for a distinct purpose. This is done so that there will be no interference by the rim of the beverage container defined by the portion of the top end just outside the score line which might otherwise make it difficult to partially or completely remove the drinking straw from the beverage container for straightening. By projecting upwardly and inwardly, the drinking straw will always pop through the pour opening for ease of removal by the consumer.

While in the foregoing there has been set forth a preferred embodiment of the invention, it is to be understood that the invention is only to be limited by the spirit and scope of the appended claims.

I claim:

1. A beverage container having a drinking straw packaged with a beverage therein, comprising:

a hollow container having a top end and a bottom end joined by a side wall, said top end having means defining a pour opening therein and including means normally sealing said pour opening, said hollow container being filled with said beverage to a level near said top end thereof;

said sealing means being releasable upon demand to expose said pour opening for access to said beverage in said hollow container; and a drinking straw disposed in said hollow container, said drinking straw comprising a tube having an open drinking passage extending completely therethrough and initially being bent intermediate opposing ends thereof into a generally circular configuration substantially disposed in a plane with said opposing ends in generally adjacent relation, said drinking straw floating on said beverage near said top end of said hollow container;

said drinking straw including means for bending said tube into said generally circular configuration, said bending means being adapted to maintain said tube in said generally circular configuration with said drinking passage open, said bending means also being adapted to accommodate bending of said tube into a generally straight configuration for use of said drinking straw;

at least one of said opposing ends of said tube being bent to project at an angle to said plane defined by said tube in said generally circular configuration, said one of said opposing ends of said tube projecting upwardly of said plane and inwardly of said generally circular configuration, said one of said opposing ends of said tube projecting upwardly of said plane by a distance sufficient to extend through said pour opening for removal of said tube upon release of said sealing means;

said tube being at least partially removable from said hollow container through said pour opening, said tube being substantially bent from said generally circular configuration into said generally straight configuration during said at least partial removal from said hollow container, said tube thereafter being reinsertable into said hollow container through said pour opening;

whereby said drinking straw can be packaged in said beverage container with said beverage in a first configuration and can be at least partially removed from said beverage container for reinsertion for drinking said beverage in a second configuration.

2. The beverage container as defined by claim 1 wherein said hollow container is generally cylindrical in shape, said top end and said bottom end being generally circular in shape, said side wall being generally cylindrical in shape.

3. The beverage container as defined by claim 1 wherein said means defining said pour opening includes a score line in said top end and said means normally sealing said pour opening includes an integral portion of said top end.

4. The beverage container as defined by claim 3 wherein said integral portion of said top end defines a tab disposed inwardly of said score line, and including means for at least partially separating said tab along said score line from the remainder of said top end.

5. The beverage container as defined by claim 4 wherein said separating means includes a lever normally disposed in generally parallel relationship to said top end, said lever being secured to said top end for pivotal movement relative thereto.

6. The beverage container as defined by claim 5 wherein said lever includes a finger engaging end and a tab engaging end, said lever being mounted for pivotal movement intermediate said finger engaging end and said tab engaging end.

7. The beverage container as defined by claim 6 wherein said tab engaging end of said lever is disposed over said tab, said finger engaging end of said lever being disposed in longitudinally spaced relation thereto.

8. The beverage container as defined by claim 7 including a rivet mounting said lever to said top end for pivotal movement, said rivet being disposed adjacent said tab engaging end in remote relation to said finger engaging end of said lever.

9. The beverage container as defined by claim 1 wherein said tube includes a plurality of corrugations intermediate said opposing ends to define said bending means, said corrugations being disposed to allow said tube to be bent into said generally circular configuration.

10. The beverage container as defined by claim 9 wherein said corrugations are uniformly disposed at a plurality of discrete locations along said tube, said corrugations terminating at points inwardly of said opposing ends of said tube.

11. The beverage container as defined by claim 9 wherein said corrugations are uniformly disposed substantially entirely along said tube, said corrugations terminating at points inwardly of said opposing ends of said tube.

12. The beverage container as defined by claim 1 wherein said opposing ends are each bent to project at an angle to said plane defined by the portion of said tube in said generally circular configuration, one of said opposing ends projecting upwardly of said plane and inwardly of said generally circular configuration and the other of said opposing ends projecting downwardly of said plane and inwardly of said generally circular configuration.

13. A carbonated beverage container having a drinking straw packaged with a carbonated beverage therein, comprising:

a generally cylindrical hollow container having a generally circular top end and a generally circular bottom end joined by a generally cylindrical side wall, said top end having means defining a pour opening therein and including means normally sealing said pour opening, said generally cylindrical hollow container being filled with said carbonated beverage to a level near said generally circular top end thereof;

said means defining said pour opening including a score line in said generally circular top end and said means normally sealing said pour opening being an intergral portion of said generally circular top end, said integral portion of said generally circular top end defining a tab disposed inwardly of said score line and including means for at least partially separating said tab along said score line from the remainder of said generally circular top end;

said tab being at least partially separable upon demand to expose said pour opening for access to said carbonated beverage in said generally cylindrical hollow container; and a drinking straw disposed in said generally cylindrical hollow container, said drinking straw comprising a tube having an open drinking passage extending completely therethrough and initially being bent intermediate opposing ends thereof into a generally circular configuration substantially disposed in a plane with said opposing ends in generally adjacent relation, said drinking straw floating on said carbonated beverage near said generally circular top end of said generally cylindrical hollow container;

said drinking straw including a plurality of corrugations intermediate said opposing ends for bending of said tube into said generally circular configuration, said corrugations being adapted to maintain said tube in said generally circular configuration with said drinking passage open, said corrugations also being adapted to accommodate bending said tube into a generally straight configuration for use of said drinking straw;

at least one of said opposing ends of said tube being bent to project at an angle to said plane defined by said tube in said generally circular configuration, said one of said opposing ends of said tube projecting upwardly of said plane and inwardly of said generally circular configuration, said one of said opposing ends of said tube projecting upwardly of said plane by a distance sufficient to extend through said pour opening for removal of said tube;

said tube being at least partially removable from said generally cylindrical hollow container through said pour opening, said tube being substantially bent from said generally circular configuration into said generally straight configuration during said at least partial removal from said generally cylindrical hollow container, said tube thereafter being reinsertable into said hollow container through said pour opening;

whereby said drinking straw can be packaged in said carbonated beverage container with said carbonated beverage in a first configuration and can be at least partially removed from said carbonated beverage container for reinsertion for drinking said carbonated beverage in a second configuration.

14. The carbonated beverage container as defined by claim 13 wherein said corrugations are uniformly disposed at a plurality of discrete locations along said tube, said corrugations terminating at points inwardly of said opposing ends of said tube.

15. The carbonated beverage container as defined by claim 13 wherein said corrugations are uniformly disposed substantially entirely along said tube, said corrugations terminating at points inwardly of said opposing ends of said tube.

16. The carbonated beverage container as defined by claim 14 wherein said opposing ends are each bent to project at an angle to said plane defined by the portion of said tube in said generally circular configuration, one of said opposing ends projecting upwardly of said plane and inwardly of said generally circular configuration, the other of said opposing ends projecting downwardly of said plane and inwardly of said generally circular configuration.

17. The carbonated beverage container as defined by claim 16 wherein said separating means includes a lever normally disposed in generally parallel relationship to said generally circular top end, said lever being secured to said generally circular top end for pivotal movement relative thereto and including a finger engaging end and a tab engaging end, said lever being mounted for pivotal movement intermediate said finger engaging end and said tab engaging end.

18. The carbonated beverage container as defined by claim 17 wherein said tab engaging end of said lever is disposed over said tab, said finger engaging end of said lever being disposed in longitudinally spaced relation thereto, and including a rivet mounting said lever to said top end for pivotal movement, said rivet being disposed adjacent said tab engaging end in remote relation to said finger engaging end of said lever.

19. A method of packaging a drinking straw in a beverage container comprising the steps of:

providing a hollow container having a side wall joined to a bottom end and having a separate top end;

forming said top end to have means defining a pour opening therein and to have means for releasably sealing said pour opening;

filling said hollow container with a beverage while said top end is still separate from the remainder of said hollow container;

providing a drinking straw comprising a tube having opposing ends and having an open drinking passage extending completely therethrough;

bending said tube intermediate said opposing ends into a generally circular configuration substantially disposed in a plane with said opposing ends in generally adjacent relation;

bending one of said opposing ends to project upwardly of said plane and inwardly of said generally circular configuration;

placing said drinking straw into said hollow container such that said generally circular configuration floats on said beverage; and sealing said top end to said side wall of said hollow container with said upwardly and inwardly projecting end of said tube in engagement therewith.

20. The method of packaging as defined by claim 19 wherein said opposing ends of said tube are each bent to project at an angle to said plane defined by the portion of said tube in said generally circular configuration, one of said opposing ends of said tube projecting upwardly of said plane and inwardly of said generally circular configuration, the other of said opposing ends of said tube projecting downwardly of said plane and inwardly of said generally circular configuration.

* * * * *